US008539633B1

(12) United States Patent
Langley et al.

(10) Patent No.: US 8,539,633 B1
(45) Date of Patent: Sep. 24, 2013

(54) GUTTER APPLICATOR

(76) Inventors: Tim S. Langley, Travelers Rest, SC (US); Keith Lawson Brackett, Bowling Green, SC (US)

( * ) Notice: Subject to any disclaimer, the term of this patent is extended or adjusted under 35 U.S.C. 154(b) by 1126 days.

(21) Appl. No.: 12/386,112

(22) Filed: Apr. 14, 2009

(51) Int. Cl.
*A47L 23/04* (2006.01)

(52) U.S. Cl.
USPC ..... 15/210.1; 15/208; 15/209.1

(58) Field of Classification Search
USPC ..... 15/208, 209.1, 210.1
See application file for complete search history.

(56) References Cited

U.S. PATENT DOCUMENTS

| | | | | |
|---|---|---|---|---|
| 2,824,328 | A | 2/1958 | Bedford | |
| 3,108,303 | A | 10/1963 | Unterbrink et al. | |
| 3,339,220 | A * | 9/1967 | Barry | 15/233 |
| 3,464,079 | A | 9/1969 | Palmeri | |
| 3,728,755 | A * | 4/1973 | Whalen | 15/210.1 |
| 4,658,461 | A * | 4/1987 | Roe et al. | 15/210.1 |
| 4,674,144 | A * | 6/1987 | Palmeri | 15/210.1 |
| 4,893,369 | A | 1/1990 | Johnson | |
| 5,361,442 | A | 11/1994 | Payne et al. | |
| 5,432,972 | A | 7/1995 | Polzin et al. | |
| 2004/0205922 | A1 * | 10/2004 | Cowdery | 15/235 |
| 2006/0117510 | A1 | 6/2006 | Sellers | |
| 2009/0255075 | A1 * | 10/2009 | Carlson et al. | 15/104.94 |

* cited by examiner

*Primary Examiner* — Lee D Wilson
*Assistant Examiner* — Shantese McDonald
(74) *Attorney, Agent, or Firm* — McNair Law Firm, P.A.; Douglas W. Kim

(57) ABSTRACT

An applicator for applying cleansing and stain removal chemicals to the outer surfaces of a gutter. The applicator includes a shaped head adapted to the contours of the gutter outer surface for applying the chemical evenly. The head carries an applicator pad which carries and deposits the chemical over the front and bottom surfaces of the gutter.

12 Claims, 4 Drawing Sheets

GUTTER APPLICATOR

BACKGROUND OF THE INVENTION

It is well known that the outer surfaces of gutters become stained with water marks while also having dirt particles adhere therewith. To date, most modes for cleaning the outer surfaces of gutters include brushes which have difficulty carrying soap and water for washing the dirt and stain from the gutter as is illustrated in Publication No. US2004/0064909 A1. The arrangement here taught requires scrubbing with pressure and a back and forth motion to clean the gutter.

It is a primary object of the instant invention to provide means and a method of facilitating the removal of bonded water marks from the gutter face with a minimum of effort.

Another object of the invention is the provision of a chemical applicator for the application of the chemical over the outer faces of the gutter.

Another object of the invention is the provision of a lightweight applicator which may attach with an extendable handle which allows for easy application of chemical to the gutter face without the need for a ladder.

Another object of the invention is the provision of a unitary applicator head which includes fastener members to secure an applicator pad in position.

Another object of the invention includes an applicator pad shaped to engage with the applicator in a secure stable invention.

Another object of the invention includes a clevis/knuckle connector between the carrier and the pole.

Another object of the invention is the provision of an injection molded applicator.

SUMMARY OF THE INVENTION

An applicator for applying chemicals onto the exterior surface of a gutter for cleaning and removing water marks and other films. The applicator includes a generally L-shaped carrier having a generally upright wall connected at its lower end with a base wall. A generally rectangular applicator pad which extends over and is engaged with the inner surfaces of the upright walls and base is provided. The pad includes a generally triangular-shaped tab formed along opposed widthwise outer edges and a plurality of holes formed along opposed lengthwise outer edges. The tabs and holes are adapted to engage with securing members carried by the carrier for securing the applicator in position and in engagement with the inner surfaces of the carrier.

The applicator pad comprises one of lambs wool or synthetic lambs wool.

An applicator for applying chemicals onto an exterior surface of a gutter for removing stains such as water marks. The applicator comprises a generally L-shaped carrier having a generally upright wall and a base wall which extends generally perpendicularly of said upright wall. Each wall has an inner side and a back side.

A generally wool-like applicator pad is positioned over and covers the inner sides of the upright and base walls.

A clevis member is provided on the back side of the upright wall and includes a pin spaced a selected distance from the back side of the upright wall.

A knuckle member having a shaped head including an upper shoulder, a lower shoulder and a pin receiving opening is carried by pole. The knuckle member includes an opening comprising a pair of generally inwardly directed cone-shaped configurations forming a small opening centrally of the knuckle. The pin is adapted to pass through the opening to retain the knuckle a selected distance from the back side of the upright wall. The knuckle and the back side acting to position the knuckle in first, second and third positions. The cone-shaped openings allow the knuckle toggle-type movement.

The method of removing water marks from gutters comprising the steps of:

I. Providing an applicator of generally L-shape with an upright wall contoured to fit an outer face of a gutter and a generally planar base wall contoured to generally fit a lower gutter face;

II. Providing a lambs wool or synthetic lambs wool pad and securing said pad to engage over inner surfaces of the upright and base walls;

III. Applying chemicals to the pad and subsequently moving the head slowly over the gutter outer and lower faces lightly engaging the outer and lower faces with the pad covering the upright and base walls removing the water marks from the gutter.

The construction designed to carry out the invention will hereinafter be described, together with other features thereof.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
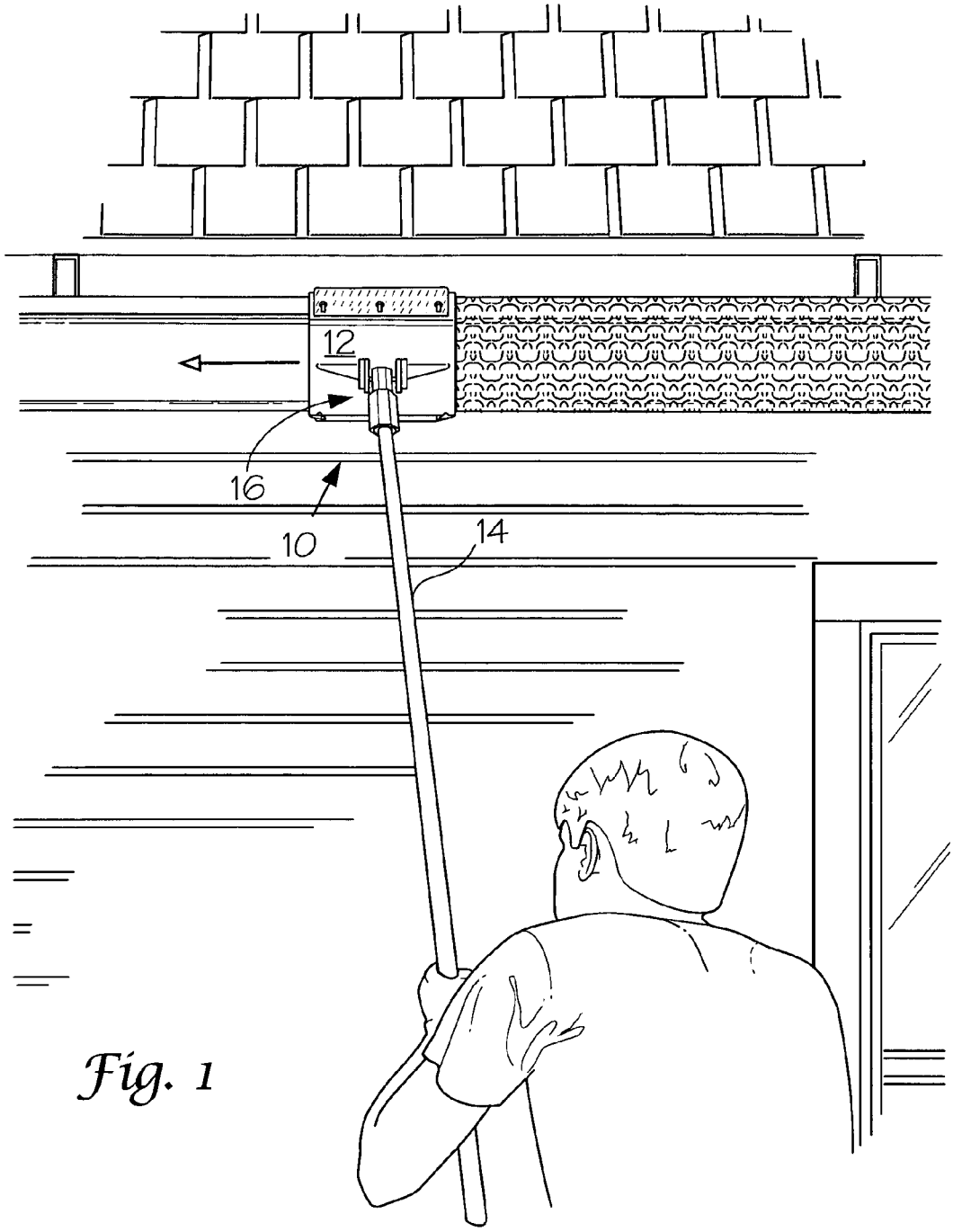
FIG. 1 is a perspective view of the applicator of the invention in use.
Figure 2:
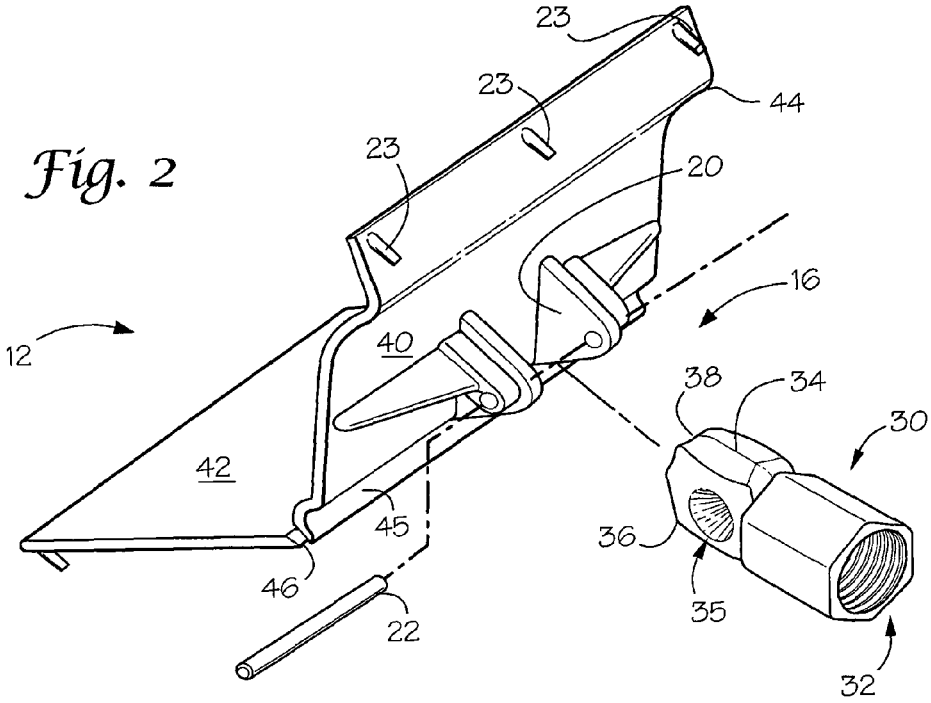
FIG. 2 is an exploded perspective view of the L-shaped carrier.

Turning now to the drawings, FIG. 1 shows generally the manner of use of the instant applicator 10. The applicator includes a generally L-shaped carrier 12 supported on pole 14 which is in turn wielded by an operator. Pole 14 may be of fixed length or it may be lengthwise adjustable by any of several known methods.

The upper end of pole 14 mounts knuckle 30, which secures with clevis connector 16, which is carried by the outer side of upright wall 40 of carrier 12. (See FIGS. 2-4 and 7.)

Clevis connector 16, through pin 22, engages with knuckle 30 which is supported on pole 14. (See FIGS. 1-4.)

The clevis connector comprises spaced extensions 20 which protrude from the outer surface of upright wall 40. The extensions are adapted to receive pin 22 at a fixed distance from the wall.

Knuckle 30 comprises a shaped engaging head 34 and a receiving section 32. Receiving section 32 comprises an opening adapted to engage with an end of pole 14 in known manner. Engaging head 34 includes a pair of inwardly directed and opposed cone-shaped openings 35 which terminate with a hole at the center of head 34. The hole is of a size to loosely receive pin 22. Head 34 is shaped with a generally arcuate forward end arranged between lower shoulder 36 and upper shoulder 38.

The spacing of pin 22 from the back of upright wall 40 is such that when pin 22 is positioned through opening 35, head 34 is releasably maintained in one of three semi-fixed positions. In a first position, head 34 is generally perpendicular of upright wall 40. (See FIG. 4.) In this position, head 34 may pivot slightly between shoulders 36, 38 or about 25%. Movement upwardly is limited by shoulder 38, engaging wall 40 and movement downwardly is limited by shoulder 36 engaging wall 40.

In a second position, head 34 is in a generally upright position. (See FIG. 3.) In the second position, head 34 is pivotal slightly between engagement of shoulder 36 with wall 40 and with knuckles 30 being generally parallel with wall 40.

The third position is the reverse of the second position. In the third position, head 34 may pivot slightly between shoulder 38 and wall 40 with knuckle 30 again being generally parallel with wall 40.

Knuckle 30 is movable between the three positions with the application of pressure in the direction of desired movement. In each of the selected positions, head 34 is releasably retained.

The first position is appropriate for use when the gutter being cleaned is in a generally lower position, i.e. even with or slightly above or below the height of the operator.

The second position is used when cleaning a gutter which is in an elevated position or well above the height of the operator.

The opposed concave openings 35, in combination with pin 22, allow a lateral or rocking movement between knuckle 30 and carrier 12 similar to movement allowed by a universal joint or multiple position toggle-type movement.

Figure 3:
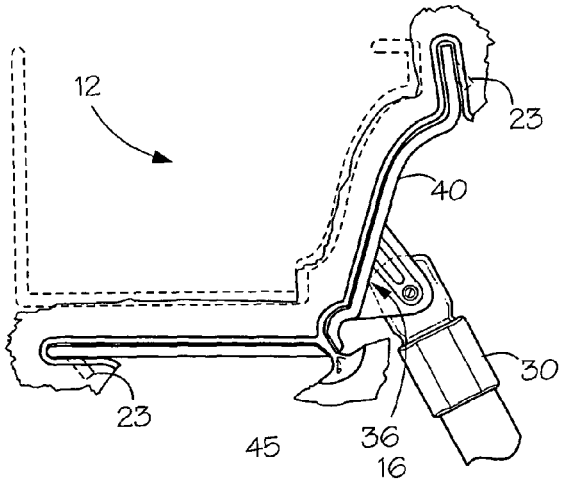
FIG. 3 is a side view of the carrier in combination with an applicator pad and gutter.
Figure 4:
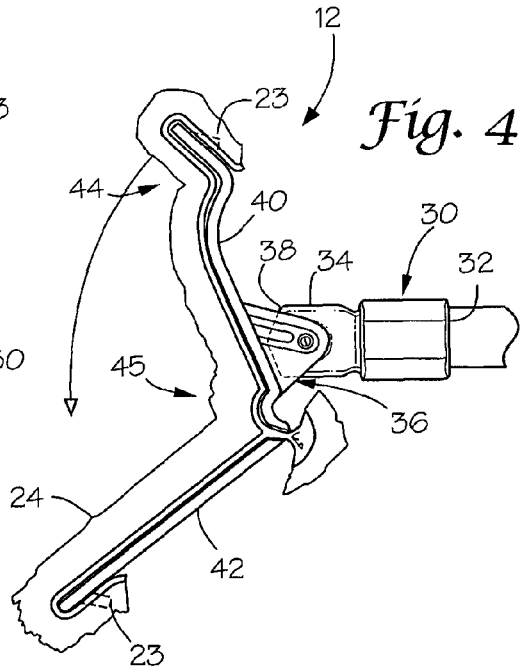
FIG. 4 is a side view similar to FIG. 3.

Turning now to FIGS. 2-6, carrier 12 will be described in detail. The carrier is generally L-shaped having a generally upright wall 40 connected along its lower edge with base wall 42. Upright wall 40 includes a generally concave section 44 adjacent its upper end and a generally convex section 45 adjacent its lower edge. The area between the concave and convex sections comprises a generally planar surface. This configuration generally conforms with the outer contour of a gutter face as illustrated in FIG. 3. Minor and obvious changes may be made should the gutter configuration be slightly different.

On the outer face and adjacent the outer edge of upright and base walls 40, 42 there are provided a plurality of hooks 23. Hooks 23 are evenly spaced across the outer edges of walls 40 and 42 of carrier 12 and are arranged to extend generally downwardly or away from the outer edges at about a 45% angle.

Figure 5A:
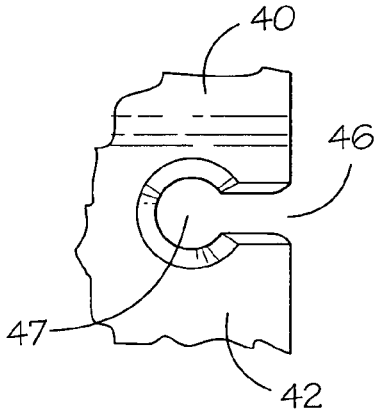
FIG. 5A is an exploded top view of the slot.
Figure 5B:
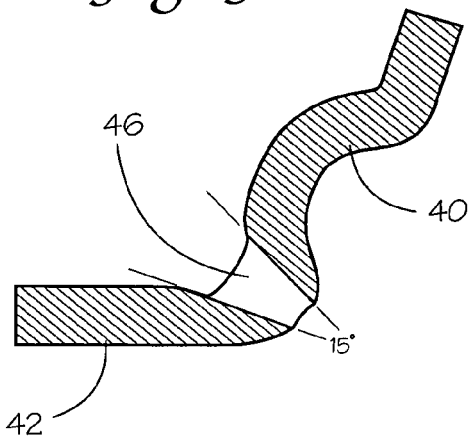
FIG. 5B is a broken away side view of FIG. 5A.
Figure 6:
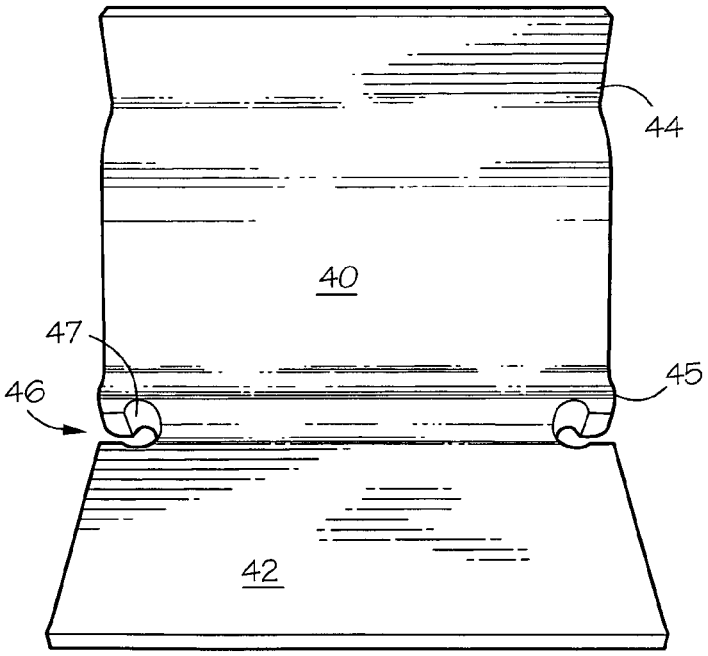
FIG. 6 is a front view of the carrier.
Figure 7:
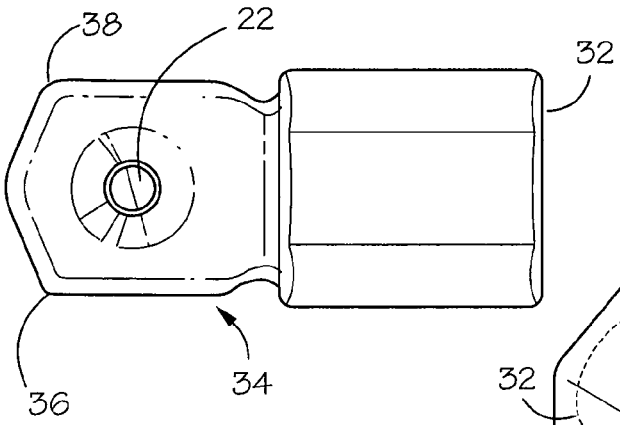
FIG. 7 is a side view of the knuckle.
Figure 8:
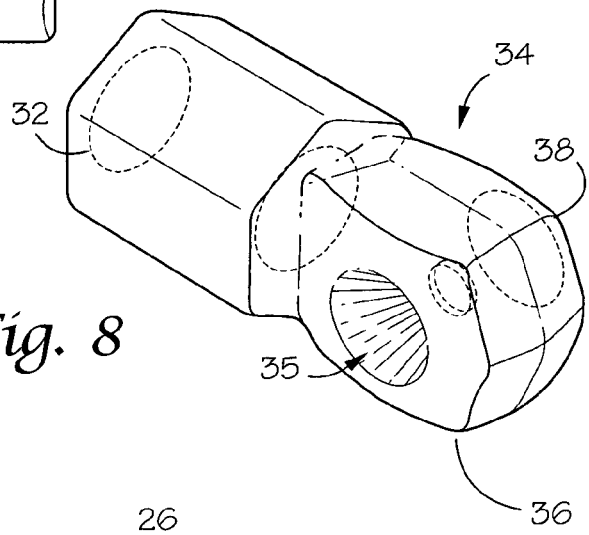
FIG. 8 is a perspective view of the knuckle.

A pair of opposed and inwardly directed slots 46 are formed along the intersection of upright and base walls 40, 42. (See FIGS. 5A, 5B and 6.) Each slot terminates with a circular opening 47, as best shown in FIG. 6. Referring to FIGS. 5A and 5B, the inner walls of slots 46, to include the circular opening, are formed at an inwardly directed angle of about 15° making the slot larger adjacent the inner side of carrier 12 and smaller adjacent outer side thereof.

Figure 9:
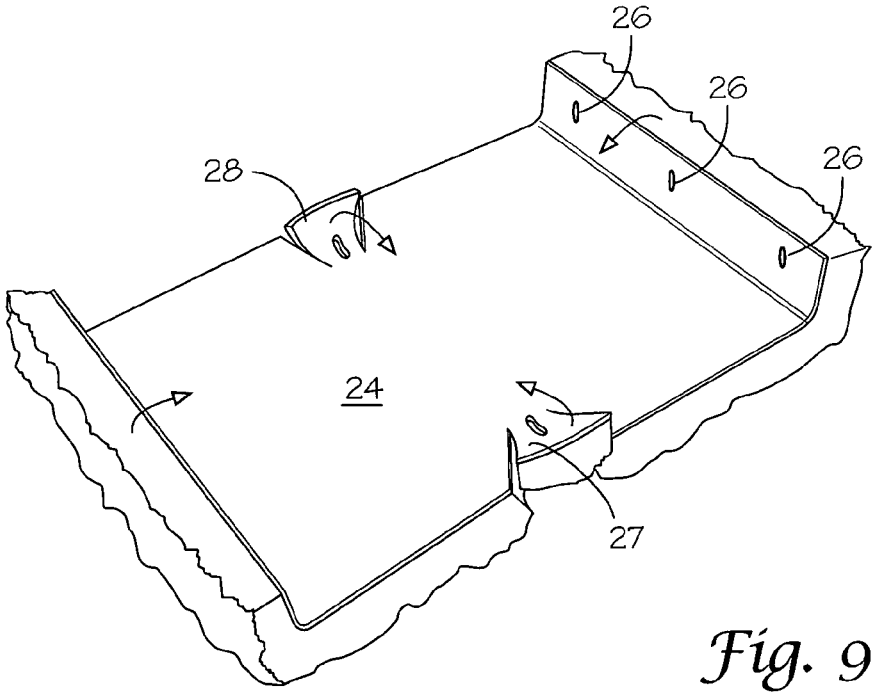
FIG. 9 is a perspective view of the pad.

Turning now to FIG. 9, applicator pad 24 is shown. The applicator pad is formed of lambs wool or of synthetic lambs wool. The pad is cut into a generally rectangular shape which is about an 1" or 1.5" longer than applicator 10. Adjacent opposed ends of the applicator pad there are formed a plurality of spaced generally circular holes 26 which extend across the pad. The holes are laterally located to overlie hooks 23. Generally centrally of and in opposed positions along opposed edges a pair of tabs 28 are formed at a location which overlies the intersections of walls 40, 42 along with slots 46. The tabs are about 1.5" long adjacent the edge of pad 24 forming an outer end and taper inwardly to form an inner end of only about ¾". The tabs are about 1" in length. An opening or cut-out may be formed centrally of the inner ends of tab 28.

In use, pad 24 is laid over the inner faces of walls 40, 42, its ends are bent over the outer edges of the carrier wall and holes 26 are engaged with hooks 23. Tabs 28 are drawn through slots 46 which engage therewith, locking pad 24 in position adjacent the outer surfaces of walls 40, 42. Knuckle 30 is adjusted to the proper work position, generally position two, the chemical cleaner is applied to pad 24. At this time the applicator is ready to apply the chemical onto the gutter using only a few light strokes. If desired, the chemical may then be washed away.

The chemical cleaner may consist of any all-purpose cleaner/degreaser which is not acid based.

It is preferred that the applicator, to include carrier 12, knuckle 30 and pole 14 be formed of plastic by injection molding. However, any material or combination of materials formed by any known process may be used so long as the strength and weight are within desirable limits.

While a preferred embodiment of the invention has been described using specific terms, such description is for illustrative purposes only, and it is to be understood that changes and variations may be made without departing from the spirit or scope of the following claims.

What is claimed is:

1. An applicator for applying chemicals onto exterior gutter surfaces for cleaning and removing water marks comprising:

a generally L-shaped carrier having a generally upright wall connected at a lower end with a base wall forming an intersection;

a generally rectangular applicator pad shaped to extend over and be engaged with inner surfaces of said upright wall and said base wall, said pad including a soft engaging surface;

a generally triangular-shaped tab formed along opposed length-wise outer edges of said applicator pad and a plurality of holes formed along opposed width-wise outer edges of said applicator pad wherein;

said tabs and said holes are adapted to engage with securing members carried by said carrier securing said applicator in position and in engagement with inner surfaces of said carrier and said securing members securing with said tabs comprise slots formed along said intersection.

2. The applicator of claim 1 wherein said applicator pad comprises one of lambs wool and synthetic lambs wool.

3. The applicator of claim 1 wherein said securing members securing with said holes comprise a plurality of pins.

4. The applicator of claim 3 wherein said pins extend away from said back sides by about a 45% angle.

5. The applicator of claim 1 including a clevis member having a pin formed along an outer side of said upright wall, said clevis member being adapted to secure with a pole.

6. The applicator of claim 5 wherein said pole includes a knuckle which engages with said pin, said knuckle and pin providing a plurality of restricted and generally universal positions for said pole relative to said carrier.

7. An applicator for applying chemicals onto exterior gutter surfaces for cleaning and removing water marks comprising:

a generally L-shaped carrier having a generally upright wall connected at a lower end with a base wall forming an intersection;

a generally rectangular applicator pad shaped to extend over and be engaged with inner surfaces of said upright wall and said base wall, said pad including a soft engaging surface wherein said upright wall is shaped to have a generally concave configuration adjacent an outer end and a generally convex configuration adjacent the connection with said base wall;

a generally triangular-shaped tab formed along opposed width-wise outer edges of said applicator pad and a plurality of holes formed along opposed length-wise outer edges of said applicator pad wherein;

said tabs and said holes are adapted to engage with securing members carried by said carrier securing said applicator in position and in engagement with inner surfaces of said carrier.

8. An applicator for applying chemicals onto exterior gutter surfaces for cleaning and removing water marks comprising:

a generally L-shaped carrier having a generally upright wall connected at a lower end with a base wall forming an intersection;

a generally rectangular applicator pad shaped to extend over and be engaged with inner surfaces of said upright wall and said base wall, said pad including a soft engaging surface;

a generally triangular-shaped tab formed along opposed width-wise outer edges of said applicator pad and a plurality of holes formed along opposed length-wise outer edges of said applicator pad wherein;

said tabs and said holes are adapted to engage with securing members carried by said carrier securing said applicator in position and in engagement with inner surfaces of said carrier wherein said securing members engaging said tabs comprise a pair of slots extending from opposed outer edges of said upright and base walls, said slots being operative to engage with and said tabs in position.

9. The applicator of claim 8 wherein said slots terminate with a circular opening.

10. The applicator of claim 8 wherein said slots are tapered from said inner surface to said outer surface by 15% forming an outer opening smaller than an inner opening.

11. An applicator for applying chemicals onto an exterior surface of a gutter for removing satins such as water marks, comprising:

a generally L-shaped carrier having a generally upright wall and a base wall which extends generally perpendicularly of said upright wall, each said wall having an inner side and a back side;

a generally wool-like applicator covering said inner side of said upright and base walls;

a clevis member on said back side of said upright wall, said clevis member having a pin spaced from said back side of said upright wall;

a knuckle member having a shaped head including an upper shoulder, a lower shoulder and a pin receiving opening, said opening comprising a pair of generally inwardly directed cone-shaped configurations;

said pin being adapted to pass through said opening retaining said knuckle a distance from said back side of said upright wall; wherein, said upper and lower of said shoulders restrict pivotal movement of said knuckle within a first position while one of said upper and lower of said shoulders restrict pivotal movement of said knuckle within a second position.

12. The application of claim 11 wherein said cone-shaped openings allows said knuckle toggle movement.

* * * * *